US007195082B2

(12) United States Patent
Adam et al.

(10) Patent No.: US 7,195,082 B2
(45) Date of Patent: Mar. 27, 2007

(54) DRILL HEAD STEERING

(76) Inventors: Scott Christopher Adam, c/-CRC Mining University of Experimental Mine Isles Road, Indooroopilly, Queensland (AU) 4068; Timothy Gregory Hamilton Meyer, 24 Hove Street, Highgate Hill, Queensland (AU) 4101

( * ) Notice: Subject to any disclaimer, the term of this patent is extended or adjusted under 35 U.S.C. 154(b) by 0 days.

(21) Appl. No.: 10/531,711

(22) PCT Filed: Oct. 20, 2003

(86) PCT No.: PCT/AU03/01391

§ 371 (c)(1),
(2), (4) Date: Apr. 18, 2005

(87) PCT Pub. No.: WO2004/035984

PCT Pub. Date: Apr. 29, 2004

(65) Prior Publication Data

US 2006/0000644 A1 Jan. 5, 2006

(30) Foreign Application Priority Data

Oct. 18, 2002 (AU) ..... 2002952176

(51) Int. Cl.
*E21B 7/04* (2006.01)

(52) U.S. Cl. ..... 175/61; 175/67; 175/73

(58) Field of Classification Search ..... 175/61, 175/67, 73, 424

See application file for complete search history.

(56) References Cited

U.S. PATENT DOCUMENTS 1,435,144 A 11/1922 Bignell
1,660,999 A 2/1928 MacDonell
1,865,853 A 7/1932 Granville
2,282,431 A 5/1942 Smith et al.
2,516,421 A 7/1950 Robertson
2,873,092 A 2/1959 Dwyer
3,191,697 A 6/1965 Haines
3,488,765 A 1/1970 Anderson
3,844,362 A 10/1974 Elbert et al.
3,858,398 A 1/1975 Van Weele (Continued)

FOREIGN PATENT DOCUMENTS

DE 3012482 10/1981

(Continued)

OTHER PUBLICATIONS

International Search Report for PCT/AU03/01391; Nov. 28, 2003; Australian Patent Office; 3 pgs.

(Continued)

*Primary Examiner*—Hoang Dang
(74) *Attorney, Agent, or Firm*—Perkins Coie LLP

(57) ABSTRACT

A method of steering a fluid drilling head in an underground borehole drilling situation is provided by rotating the flexible hose through which high pressure is provided to the drilling head and providing a biasing force on the drilling head. The hose can be rotated from a remote surface mounted situation by rotating the entire surface rig (13) in a horizontal plane about a turntable (24) causing the vertically orientated portion of the hose (11) to rotate about its longitudinal axis. The biasing force can be provided in a number of different ways but typically results from the use of an asymmetrical gauging ring on the fluid drilling head.

12 Claims, 4 Drawing Sheets

U.S. PATENT DOCUMENTS

| | | | | | |
|---|---|---|---|---|---|
| 3,873,156 | A | | 3/1975 | Jacoby | |
| 3,874,733 | A | | 4/1975 | Poundstone et al. | |
| 3,881,775 | A | | 5/1975 | McPherson et al. | |
| 3,887,021 | A | | 6/1975 | Elbert | |
| 3,917,007 | A | | 11/1975 | Tsiferov | |
| 4,007,797 | A | | 2/1977 | Jeter | |
| 4,273,193 | A | | 6/1981 | Tompkins | |
| 4,437,706 | A | | 3/1984 | Johnson et al. | |
| 4,440,242 | A | | 4/1984 | Schmidt et al. | |
| 4,458,766 | A | | 7/1984 | Siegel | |
| 4,497,381 | A | | 2/1985 | Dickinson, III et al. | |
| 4,503,918 | A | | 3/1985 | Bergkvist et al. | |
| 4,527,639 | A | | 7/1985 | Dickinson, III et al. | |
| 4,637,479 | A | * | 1/1987 | Leising | 175/26 |
| 4,640,362 | A | | 2/1987 | Schellstede | |
| 4,674,579 | A | | 6/1987 | Geller et al. | |
| 4,714,118 | A | | 12/1987 | Baker et al. | |
| 4,754,526 | A | | 7/1988 | Tremoulet, Jr. et al. | |
| 4,765,416 | A | | 8/1988 | Bjerking et al. | |
| 4,773,113 | A | | 9/1988 | Russell | |
| 4,790,394 | A | * | 12/1988 | Dickinson et al. | 175/61 |
| 4,826,087 | A | | 5/1989 | Chinery et al. | |
| 4,850,440 | A | * | 7/1989 | Smet | 175/67 |
| 4,930,586 | A | * | 6/1990 | Turin et al. | 175/25 |
| 4,991,667 | A | * | 2/1991 | Wilkes et al. | 175/61 |
| 5,179,753 | A | | 1/1993 | Flaherty et al. | |
| 5,197,783 | A | | 3/1993 | Theimer et al. | |
| 5,255,750 | A | | 10/1993 | Wilkes, Jr. et al. | |
| 5,288,173 | A | | 2/1994 | Jenne et al. | |
| 5,314,030 | A | * | 5/1994 | Peterson et al. | 175/26 |
| 5,322,134 | A | | 6/1994 | Dahn | |
| 5,413,184 | A | | 5/1995 | Landers | |
| 5,439,066 | A | | 8/1995 | Gipson | |
| 5,492,184 | A | | 2/1996 | Jenne | |
| 5,513,713 | A | * | 5/1996 | Groves | 175/73 |
| 5,814,162 | A | | 9/1998 | Barrett et al. | |
| 5,853,056 | A | | 12/1998 | Landers | |
| 5,899,283 | A | | 5/1999 | Cox | |
| 5,950,743 | A | | 9/1999 | Cox | |
| 5,992,547 | A | | 11/1999 | Caraway et al. | |
| 6,012,536 | A | | 1/2000 | Puttmann et al. | |
| 6,089,336 | A | | 7/2000 | Nexton et al. | |
| 6,109,370 | A | | 8/2000 | Gray | |
| 6,231,270 | B1 | | 5/2001 | Cacossa | |
| 6,263,984 | B1 | | 7/2001 | Buckman, Sr. | |
| 6,470,978 | B2 | | 10/2002 | Trueman et al. | |
| 6,530,439 | B2 | | 3/2003 | Mazorow | |
| 6,866,106 | B2 | * | 3/2005 | Trueman et al. | 175/67 |
| 7,083,011 | B2 | | 8/2006 | Meyer | |
| 2005/0067166 | A1 | | 3/2005 | Trueman et al. | |

FOREIGN PATENT DOCUMENTS

| | | |
|---|---|---|
| FR | 2493907 | 5/1982 |
| GB | 2289 298 | 11/1995 |
| JP | 06346676 | 12/1994 |
| RU | 1093062 | 8/1994 |
| WO | WO-95/09963 | 4/1995 |
| WO | WO-97/21900 | 6/1997 |
| WO | WO-03/042491 | 5/2003 |

OTHER PUBLICATIONS

Derwent Abstract Accession No. 57667B/46, Class Q49, Su 649815, A (UKR Coal Hydr Minin) Feb. 28, 1979 . . </TD></TR>.

European Search Report for Application No. EP03753138; dated Mar. 7, 2006; 2 pgs.

Maramzin, A.V., "Automation and Mechanization of Tripping Processes (Review of foreign patents)", pp. 83-84, undated . .

* cited by examiner

DRILL HEAD STEERING

FIELD OF THE INVENTION

This invention relates to drill head steering and has been devised particularly though not solely for the direction control of a fluid drilling head used in borehole drilling, in mining or similar in-ground applications.

BACKGROUND OF THE INVENTION

Fluid drilling heads are utilised in a number of different borehole drilling applications and typically use a rotating head with a number of nozzles from which issue high pressure jets directed to break and erode the rock face in advance of the drill head. Fluid drilling heads of this type are described in international patent application PCT/AU96/00783.

One difficulty with fluid drilling heads of this type is controlling the direction of the head. In most applications it is highly desirable to achieve directional accuracy in the formation of a bore hole particularly in situations such as the draining of methane gas from coal seams preparatory to mining. In such situations, it is critical to achieve an even pattern of drainage bores, and to ensure that the bores are accurately placed to pass through proposed roadway locations in the mining operation.

In the past it has been difficult to accurately control or steer a fluid drilling head of this type which is fed via a flexible hose, typically either from a surface drilled location via a tight radius drilling configuration, or from an underground location for cross-panel, mine development, and exploration drilling.

SUMMARY OF THE INVENTION

In one aspect, the present invention therefore provides a method of steering a fluid drilling head of the type provided with high pressure fluid through a flexible hose, including the steps of providing a biasing force to the drilling head and controlling the direction of the biasing force by rotating the drilling head.

Preferably the step of rotating the drilling head is performed by rotating the flexible hose about its longitudinal axis.

Preferably the flexible hose is rotated from a location remote from the drilling head.

In one form of the invention, the fluid drilling head is deployed from ground level and said location remote from the drilling head is located at or above ground level.

Preferably the hose is fed from a rotatable drum having a substantially horizontal axis of rotation, and the hose is rotated by rotating the drum and associated support gear about a vertical axis substantially aligned with a vertical bore through which the hose is fed into the ground.

Alternatively the hose is rotated by a powered swivel.

Alternatively the hose is rotated by a non-powered ratcheting swivel.

Preferably, the biasing force is provided by an asymmetrical gauging ring located on the fluid drilling head.

Alternatively the biasing force is provided by partial shading of a cutting jet on the head.

Alternatively the biasing force is provided by asymmetrical retro jet sizing on the cutting head.

Alternatively the biasing force is provided by a partially deflected retro jet.

BRIEF DESCRIPTION OF THE DRAWINGS

Notwithstanding any other forms that may fall within its scope, one preferred form of the invention will now be described by way of example only with reference to the accompanying drawings in which.

DETAILED DESCRIPTION OF THE PREFERRED EMBODIMENTS

The preferred form of the invention will be described with reference to a typical mine gas drainage situation where a vertical bore is drilled from ground surface and a whipstock used to provide radial bores extending outwardly from the vertical bore at predetermined depths, but it will be appreciated that the method according to the invention can be utilised in many other fluid drilling situations including horizontal cross-panel drilling from an underground location.

Figure 1:
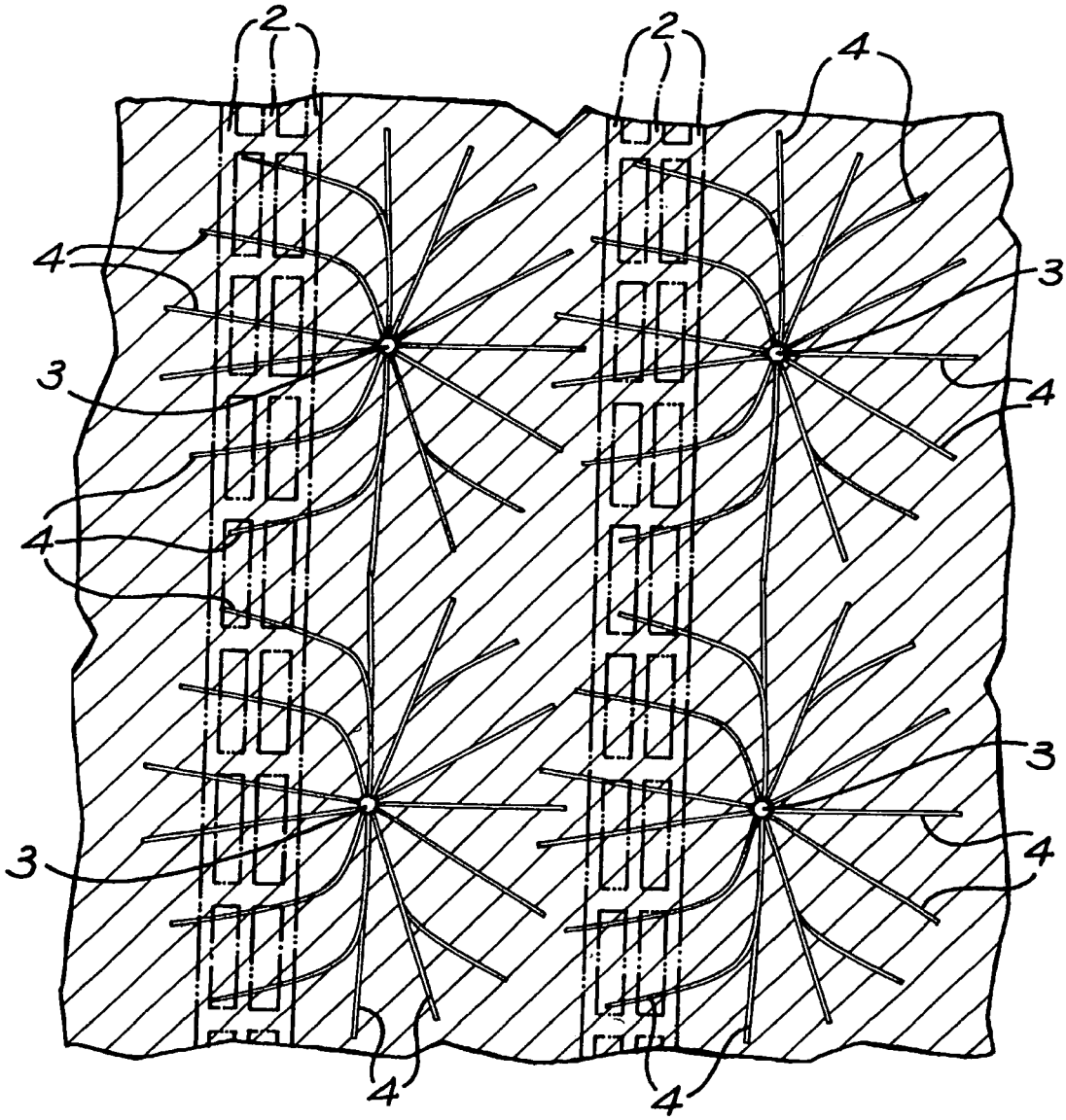
FIG. 1 is a horizontal section through a proposed underground mine roadway configuration showing the desired location of boreholes for mine gas drainage.

FIG. 1 shows a typical mine gas drainage drilling operation where it is desired to drain methane or other dangerous gasses from coal seams 1 in the location of intended roadways 2 to be cut as part of the mining operation. The mine gas drainage can be achieved safely and economically by drilling a number of vertical bores 3 from the surface and using tight radius drilling techniques to drill radial bores such as those typically shown at 4 from the vertical bores 3. It will be noticed that the radial bores must be accurately controlled in direction so as to pass through each of the separate panels in the roadways 2.

Figure 2:
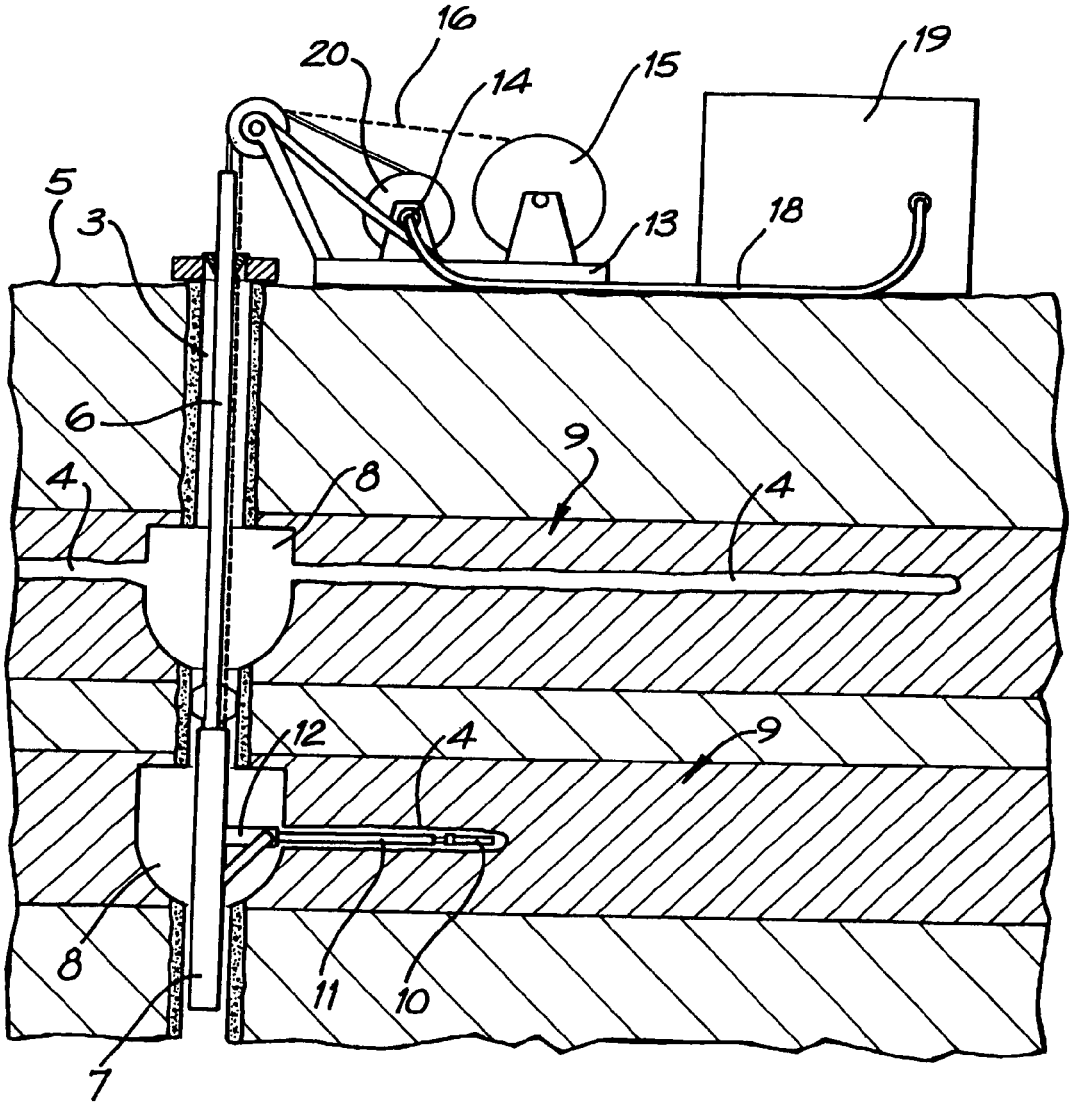
FIG. 2 is a diagrammatic vertical section through a typical tight radius drilling arrangement using a fluid drilling head fed by a flexible hose.

The tight radius drilling system can be more accurately seen in FIG. 2 where the vertical bore 3 is drilled from ground surface 5 and tubing 6 fed down the vertical bore to support a whipstock 7 in a reamed cavity 8 in a desired location for drilling the radial bores in a coal seam 9.

The fluid drilling head 10 is fed with high pressure liquid (typically water) through a flexible hose 11 which passes through the tubing 6 and is horizontally diverted by an erectable arm 12 in the whipstock 7.

The flexible tube is fed from the surface where it is stored on a rotatable drum 20 mounted on a surface rig 13 about a horizontal axis 14.

The surface rig may also incorporate other items such as a further drum 15 for a control bundle 16 and guide sheaves (not shown) arranged to direct the hose and control bundle into alignment into the vertical bore 3.

The hose reel 20 is provided with high pressure water via a feed hose 18 from a high pressure pump 19.

In order to provide steering control to the fluid drilling head 10, in order to control the vertical location of the head and keep it within the coal seam 9, and in order to direct the head in the required direction to achieve drilling patterns of the type shown in FIG. 1, the head is provided with a biasing force tending to bias or deviate the drilling head to follow a curved path. The biasing force is then orientated by rotating the drilling head by rotating the flexible hose 11. This may be achieved in a number of different ways as will be described further below.

The biasing force may be provided in a number of different ways but it has been found preferable to provide the force by using an asymmetrical gauging ring located on the fluid drilling head.

Figure 6:
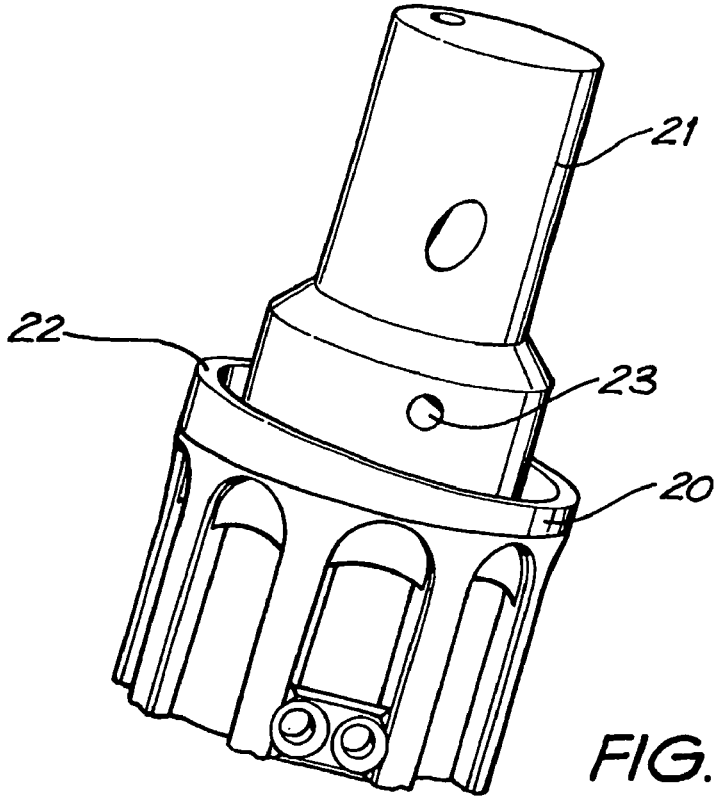
FIG. 6 is a perspective view of the forward end of a fluid drilling head showing an asymmetrical gauging ring used to provide a biasing force to the drilling head.

Our co-pending International patent application PCT/AU02/01550 describes a fluid drilling head having a gauging ring and it has been found a very simple modification to make the leading edge of the gauging ring asymmetrical as shown in FIG. 6. In this configuration, the gauging ring 20 which is concentrically mounted about the rotatable fluid jet head 21 is made asymmetrical either by having the leading edge 22 of the ring more advanced on one side of the head than the other, or by otherwise shaping the leading edge of the gauging ring in other asymmetrical manners. In this way, the fluid issuing from a side facing reaming jet nozzle 23 may be partially impeded or deflected by the leading edge of the gauging ring at one point in the rotation of the head 21 so as to provide an uneven or biased lateral force tending to send the fluid drilling head on a curved trajectory.

Alternative methods of providing a biasing force to the drilling head can be provided by offsetting the force from the retro jets used to propel the head forward as described in international patent specification PCT/AU96/00783 either by making one jet larger than the others or by partially deflecting one of the retro jets at a more extreme angle to the axis of the drilling head than the other jets.

Alternatively a fixed offset jet nozzle may be provided in the drilling head.

The preferred method of rotating the flexible hose 11 and hence the fluid drilling head 10 to orientate the biasing force in the required direction is achieved by rotating the entire surface rig 13 about the vertical axis of the flexible tube 11 where the tube feeds downwardly into the vertical bore 3. This configuration is shown diagrammatically in FIG. 3 where the surface rig 13 is rotated in a horizontal plane about a turntable 24, typically supported on the turntable by rollers 25 and at the outer end of the rig by circumferentially orientated wheels 26. In this manner, the entire surface rig is able to be rotated to effect rotation of the flexible hose 11.

Figure 4:
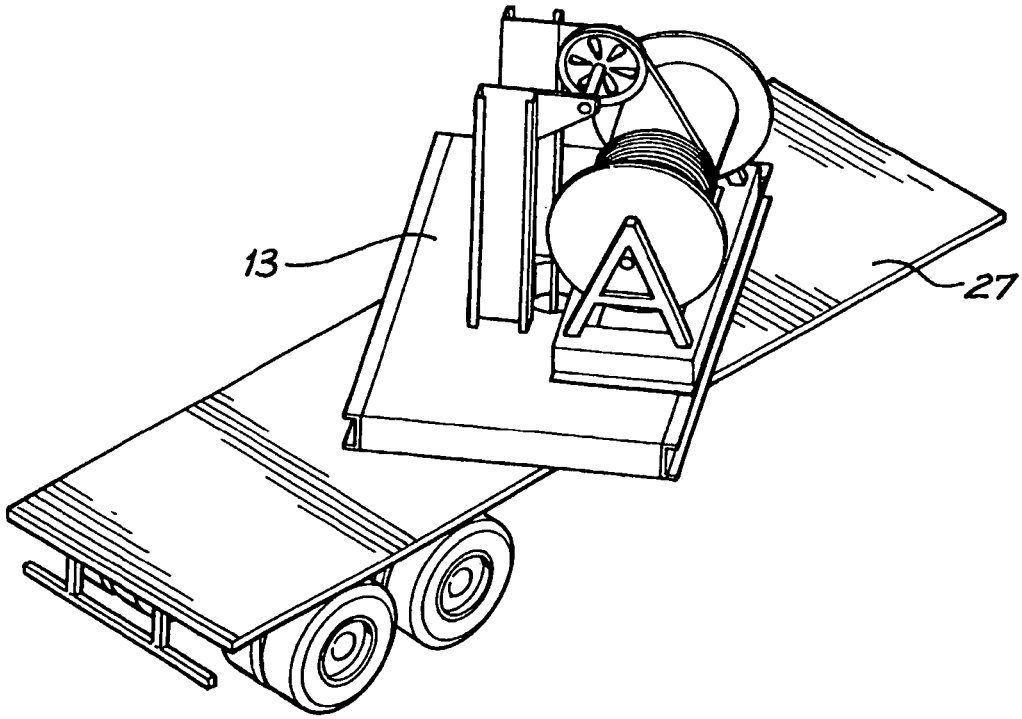
FIG. 4 is a diagrammatic perspective view of a rig similar to that shown in FIG. 3 when mounted on a truck or trailer.

As shown in FIG. 4, it is possible to mount this entire rig on the bed 27 of a truck or trailer so that the rig can be rotated, once again about the vertical portion of the flexible hose 11, allowing the entire hose to be rotated as it is fed downwardly through the bed of the truck.

Any rotation of the rig 13 as a rotary table, translates into a corresponding rotation of the hose length around its longitudinal axis, and thereby can be used to position the drill bias at any desired roll value. The necessary services that need to be connected into the rotary table or hose drum system include high pressure water, electrical power and instrumentation data cables. A high pressure water swivel can be located above the reeve frame along the axis of rotation of the table. A crude but effective method for connecting power and data cables is to wind these cables from a supply drum mounted on the semi-trailer base 27, directly onto a drum mounted onto the rotary table. Sufficient cable could be supplied to allow for e.g. 100 turns of the rotary table, considered unlikely to be achieved during the drilling of a controlled radial or lateral. At the completion of a lateral, the cables are wound back onto the supply drums, ready for the drilling of another lateral.

This method of rotating the hose from the surface has the advantage that all system components are situated on the surface and out of the hole. This is an advantage in that the correct operation of the various components can be visually checked, and also facilitates maintenance and reliability issues. The system is able to achieve excellent control of the drilling bias orientation and is able to rotate the tool in both directions.

In alternative methods of rotating the flexible hose 11, various forms of powered or un-powered swivels may be used in the hose.

Figure 5:
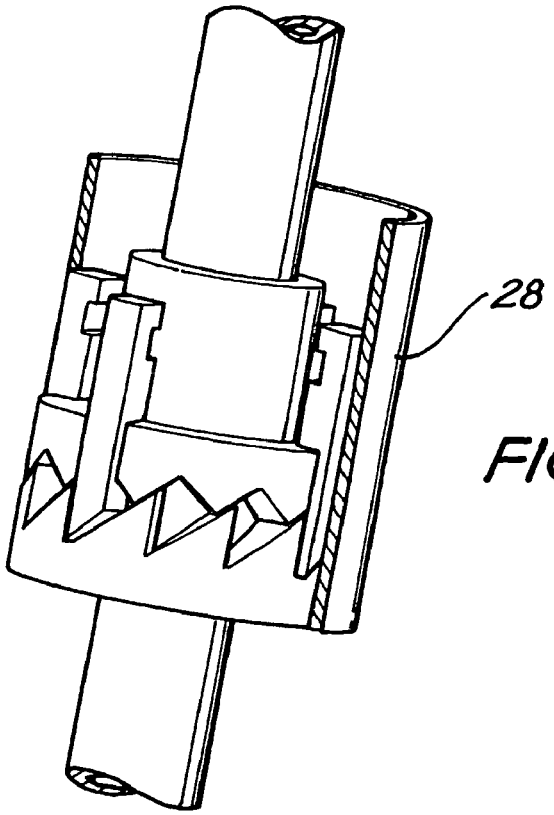
FIG. 5 is a diagrammatic view of a ratcheting swivel used to effect hose rotation in an alternative form of the invention.

For example, a mid-hose powered swivel may be inserted into the hose, typically located in the vertical well during drilling operations. The swivel can be activated from the surface to index the desired rotation amount (only in one direction and in increments of some number of degrees). Separate power lines (hydraulic or electrical) are connected to the swivel for its operation, and as such need to be fed down the well during drilling operations. A sketch of a typical swivel is shown at 28 in FIG. 5.

In yet a further alternative way of rotating the hose, a non-powered ratcheting swivel can be mounted either directly behind the drilling head 10 or at a join in the hose somewhere within the vertical bore 3. A simple yet crude means of steering, this technique relies on the high pressure hose undergoing some form of twisting as a result of either a change of pressure within the hose, or changes in hose tension.

Changes in pressures and/or tension in the hose cause the hose to rotate relative to the hose drum 12. The rotation is absorbed by the ratcheting mechanism in the swivel, meaning that the ratcheting force must be less than the resistance to turn experienced by the drilling tool or the tool and hose combination against the borehole and the whipstock hose path. When re-pressurised/re-tensioned, the hose will rotate in the opposite direction.

The ratchet on the swivel prevents the hose from twisting back to its original position relative to the drilling tool, and the drilling tool is forced to twist as a result.

This technique relies on the ability to generate a controlled relative rotation of the hose swivel as water pressure or hose tension is varied. A complicating factor is the effect of hose pressure on hose length and hence tension.

Although either the powered swivel or the non-powered ratcheting swivel could be mounted close to the drilling head, or even in the drilling head it is preferred that they are located closer to the feed drum so that the flexible hose is rotated from a location remote from the drilling head.

Although the invention has been described thus far for use where a vertical bore is drilled from the ground surface and a whipstock used to provide radial bores extending outwardly from the vertical bore, the invention has equal applicability to other fluid drilling situations such as horizontal cross-panel drilling from an underground location. This operation is used from an underground roadway to drill boreholes in adjacent seams to release dangerous gasses before the mining operation commences, or to harvest valuable gasses such as methane from coal seams for power generation.

The cross-panel drilling situation is similar to that described above except that the hose is fed from a drum mounted with its axis of rotation supported in a cradle which is in turn rotatable in a suitable support frame about an axis, typically substantially horizontal, aligned with the adjacent borehole into which the hose is fed. Although the term "horizontal" is used in this context, it will be appreciated that the borehole can be inclined but is typically closer to the horizontal than to the vertical.

Figure 3:
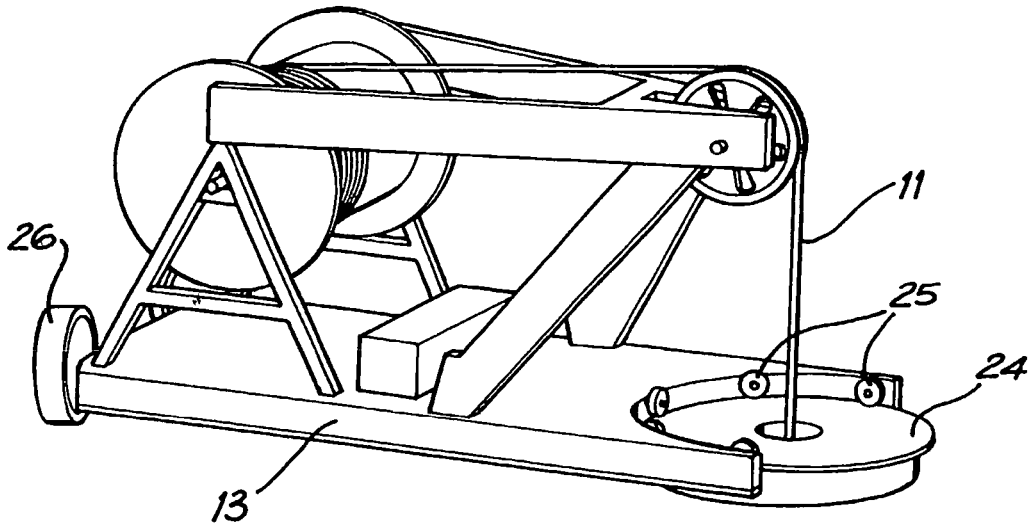
FIG. 3 is a diagrammatic perspective view of a surface located rotatable hose feed rig according to the invention.

By providing a biasing force to the fluid drilling head 10 and then controlling the direction of that force by rotating the flexible hose 11, preferably by rotating the entire surface rig in the manner shown in FIGS. 3 and 4, accurate directional control of the drilling tool is achieved. Where it is desired to drive the tool in a "straight" line, the hose may be continuously rotated resulting in a shallow elongate spiral path for the drilling head, which approximates a straight line.

Where it is desired to turn in a specified direction, the drilling head is rotated so that the biasing force urges the drilling head in the required direction, and held in that orientation until the turn is complete.

The invention claimed is:

1. A method of steering a fluid drilling head of the type provided with high pressure fluid through a flexible hose, including the steps of providing a biasing force to the drilling head and controlling the direction of the biasing force by rotating the drilling head, wherein rotating the drilling head is performed by rotating the flexible hose about its longitudinal axis.

2. A method as claimed in claim 1 wherein the flexible hose is rotated from a location remote from the drilling head.

3. A method as claimed in claim 2 wherein the hose is fed from a rotatable drum into an adjacent borehole, the rotation axis of the drum being substantially at right angles to the axis of the borehole, and wherein the hose is rotated by rotating the drum and associated support gear about the axis of the borehole.

4. A method as claimed in claim 3, wherein the hose is fed from a rotatable drum having a substantially horizontal axis of rotation, and the hose is rotated by rotating the drum and associated support gear about a vertical axis substantially aligned with the borehole.

5. A method as claimed in claim 4, wherein the fluid drilling head is deployed from ground level and said location remote from the drilling head is located at or above ground level.

6. A method as claimed in claim 3, wherein the fluid drilling head is deployed from an underground location wherein the adjacent borehole is closer to horizontal than to vertical.

7. A method as claimed in claim 1, wherein the drilling head is rotated by a powered swivel located in the flexible hose.

8. A method as claimed in claim 1, wherein the drilling head is rotated by a non-powered ratcheting swivel located in the flexible hose.

9. A method as claimed in claim 1, wherein the drilling head includes a plurality of cutting jets issuing from a rotatable head and wherein the biasing force is provided by partial shading of at least one cuffing jet over a predetermined limited arc of its rotation.

10. A method as claimed in claim 9, wherein the biasing force is provided by an asymmetrical gauging ring located on the fluid drilling head.

11. A method as claimed in claim 1, wherein the biasing force is provided by an asymmetrical arrangement of retro jets provided to propel the cutting head forwardly.

12. A method as claimed in claim 1, wherein the biasing force is provided by a fixed offset jet nozzle in the drilling head.

* * * * *

UNITED STATES PATENT AND TRADEMARK OFFICE

CERTIFICATE OF CORRECTION

PATENT NO. : 7,195,082 B2
APPLICATION NO. : 10/531711
DATED : March 27, 2007
INVENTOR(S) : Adam et al.

It is certified that error appears in the above-identified patent and that said Letters Patent is hereby corrected as shown below:

In column 5, line 25, in Claim 2, delete “claim 1” and insert -- claim 1, --, therefor.

In column 6, line 21, in Claim 9, delete “cuffing” and insert -- cutting --, therefor.

Signed and Sealed this

Fifteenth Day of July, 2008

JON W. DUDAS
*Director of the United States Patent and Trademark Office*